United States Patent [19]

Engel

[11] Patent Number: 4,559,747

[45] Date of Patent: Dec. 24, 1985

[54] CONTAINER SUPPORT APPARATUS

[76] Inventor: Thomas H. Engel, 3040 SW. 129th, Oklahoma City, Okla. 73170

[21] Appl. No.: 664,257

[22] Filed: Oct. 24, 1984

Related U.S. Application Data

[63] Continuation-in-part of Ser. No. 503,324, Jun. 10, 1983.

[51] Int. Cl.[4] ..... E04H 12/00

[52] U.S. Cl. ..... 52/40; 52/632; 248/DIG. 7

[58] Field of Search ..... 52/118, 632, 29, 40, 52/110; 248/507, 509, DIG. 7; 211/71, 78, 85

[56] References Cited

U.S. PATENT DOCUMENTS

| | | | |
|---|---|---|---|
| 2,448,456 | 8/1948 | Niksanen et al. | 248/156 |
| 2,819,547 | 1/1958 | Clements, Jr. | 40/125 |
| 2,937,760 | 5/1960 | Williams | 211/71 |
| 3,079,119 | 2/1962 | Brooks | 248/146 |
| 3,173,547 | 3/1965 | Alissandratos | 211/71 |
| 3,178,142 | 4/1965 | Koch | 248/146 |
| 3,235,094 | 2/1966 | Otto et al. | 211/71 |
| 3,527,355 | 9/1970 | Boyer | 211/71 |
| 3,638,802 | 2/1972 | Westerfield | 211/71 |
| 3,642,145 | 2/1972 | Shelton | 211/78 |
| 3,675,783 | 7/1972 | Reese | 211/71 |
| 4,513,938 | 4/1985 | Seymour | 52/118 X |

*Primary Examiner*—Carl D. Friedman
*Assistant Examiner*—Naoko N. Slack
*Attorney, Agent, or Firm*—Bill D. McCarthy

[57] ABSTRACT

An improved container support apparatus for supporting a refuse container comprising a stationary tubular member disposable in the ground; a telescoping tubular member supported by the stationary tubular member, and the telescoping tubular member being slidably moveable between a retracted position within the stationary tubular member and an extended position substantially above the surface of the ground; a stop assembly for maintaining the telescoping tubular member in its extended position; a container support member slidably disposed about the telescoping tubular member for supporting the container thereon when the telescoping tubular member is in its extended position; a handle assembly secured to the upper end portion of the telescoping tubular member for selectively moving the telescoping tubular member between the retracted and extended positions; and a linkage assembly supported by the handle assembly and pivotally connected to the stop assembly so that the telescoping tubular member can be moved to the retracted position within the stationary tubular member.

20 Claims, 8 Drawing Figures

CONTAINER SUPPORT APPARATUS

CROSS REFERENCE TO RELATED APPLICATION

This is a continuation-in-part application of copending patent application entitled "Telescoping Support Apparatus For Containers", U.S. Ser. No. 503,324, field June 10, 1983.

BACKGROUND OF THE INVENTION

1. Field of the Invention

The present invention relates to a container support apparatus, and more particularly but not by way of limitation, to an improved telescoping support apparatus for supporting and retaining containers such as refuse containers.

2. Discussion of the Prior Art

Containers used for refuse and garbage are generally located adjacent the rear area of a dwelling. In many instances the resident of the dwelling must move the container to a designated location in order to have the contents of the container picked up by a collection service. When the containers are positioned at the designated location, such as a curb area, the containers are often upset by wind or by domestic animals seeking food from the contents of the containers. While holders and support apparatus for refuse or garbage containers are generally known in the art, the prior art support apparatus, if positioned in an area in front of a dwelling such as adjacent curbing, would detract from the aesthetic qualities of the dwelling, as well as forming an obstruction in the portion of the yard containing the apparatus.

While the prior art container holders and support apparatus have met with a limited amount of success, such devices do not overcome the problem of the upsetting of the containers by the wind or by the domestic animals when the containers are placed in the designated pickup area. Thus, it would be highly desirable to provide a support apparatus for garbage or refuse containers in the pickup area which would prevent the wind or domestic animals from overturning such containers, while allowing the container support apparatus to be substantially removed from view when not in use.

The telescoping support apparatus for containers disclosed in my copending patent application, U.S. Ser. No. 503,324, filed June 10, 1983 overcomes many of the disadvantages of the prior art devices. However, certain improvements have been made in the telescoping support apparatus for containers as disclosed in my copending patent application which enable the user of the support apparatus to more readily move the apparatus from the extended position to the retracted position in the ground so as to be substantially removed from view when not in use.

SUMMARY OF THE INVENTION

The present invention relates to an improved container support apparatus for refuse containers. The improved container support apparatus is positioned at a designated pickup area for the containers, such as along the curbing in front of a dwelling and substantially prevents wind and domestic animals from upsetting the containers. Further, the support apparatus can be retracted into the ground so that it is substantially removed from view when not in use. Broadly, the present invention relates to an improved container support device for supporting at least one refuse container comprising a stationary tubular member disposable in the ground; a telescoping tubular member supported by the stationary tubular member and having a first detent slot formed in a lower portion thereof, the telescoping tubular member being slidably moveable between a retracted position within the stationary tubular member and an extended position substantially above the surface of the ground; a stop assembly pivotally supported in the lower portion of the telescoping tubular member so that one end thereof is supported within the first detent slot and extendable through the first detent slot of the telescoping tubular member when the telescoping tubular member is in the extended position; a container support member slidably disposed about the telescoping tubular member for supporting the container thereon; a handle assembly secured to the upper end portion of the telescoping tubular member for permitting selective movement of the telescoping tubular member between the extended position and the retracted position; and a linkage assembly supported by the handle assembly and pivotally connected to the stop assembly such that upon application of a lifting force on the linkage assembly the stop assembly is withdrawn from extension through the first detent slot and engagement with the stationary tubular member so that the telescoping tubular member can be moved to the retracted position within the stationary tubular member.

An object of the present invention is to provide a support apparatus for a container to prevent the container from being upset by the wind or domestic animals.

Another object of the present invention is to provide a support apparatus for a container which can be permanently affixed in a designated pickup location and which can be substantially hidden from view when not in use.

Another object of the present invention is to provide an improved, inexpensive support apparatus for containers which is adapted to be anchored within the ground and which will readily support the containers regardless of the slope or terrain of the supporting ground surface.

Another object of the present invention is to provide an improved support apparatus for refuse containers which can be secured in an extended position for support of the containers thereon and when desired readily lowered into a retracted position so that the apparatus is substantially hidden from view when not in use.

Other objects, features and advantages of the present invention will become clear upon reading the following detailed description in conjunction with the drawings and the appended claims.

BRIEF DESCRIPTION OF THE DRAWINGS

FIG. 6 is an enlarged, perspective view illustrating the interconnection of the handle assembly, the linkage and stop assembly of the improved container support apparatus of FIG. 1.

DESCRIPTION OF THE INVENTION

Figure 1:
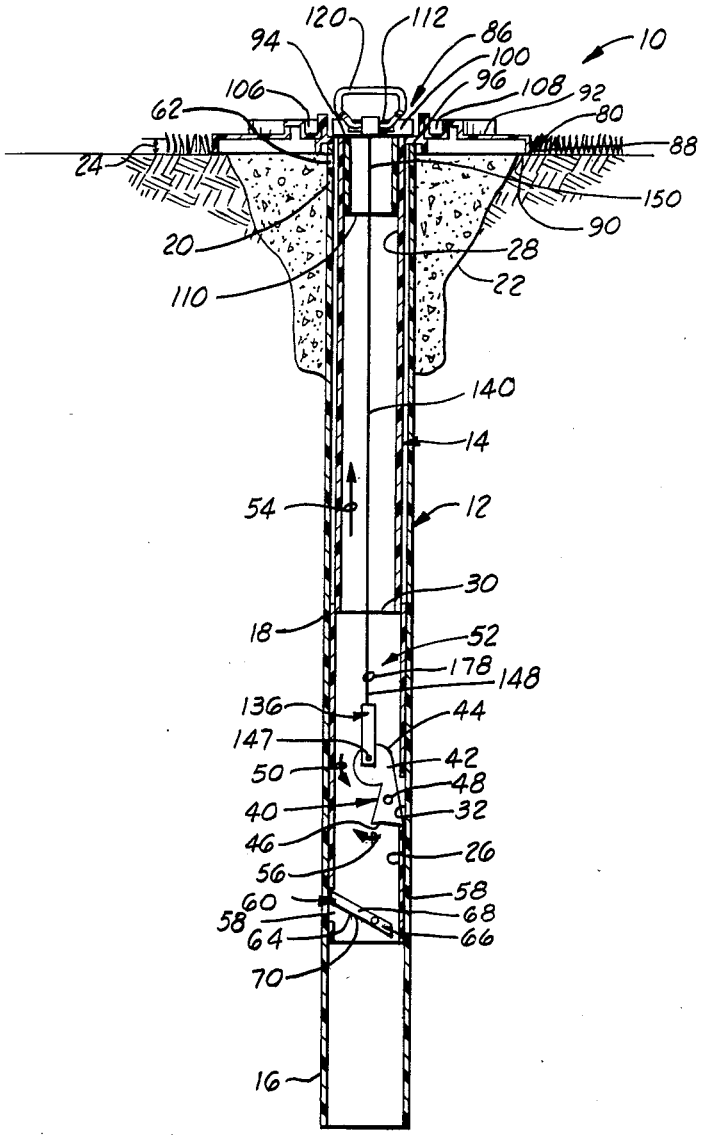
FIG. 1 is an elevational, cutaway view of an improved container support apparatus constructed in accordance with the present invention wherein the container support apparatus is in a retracted mode so that the top portion of the apparatus is disposed substantially adjacent with the surrounding terrain.
Figure 2:
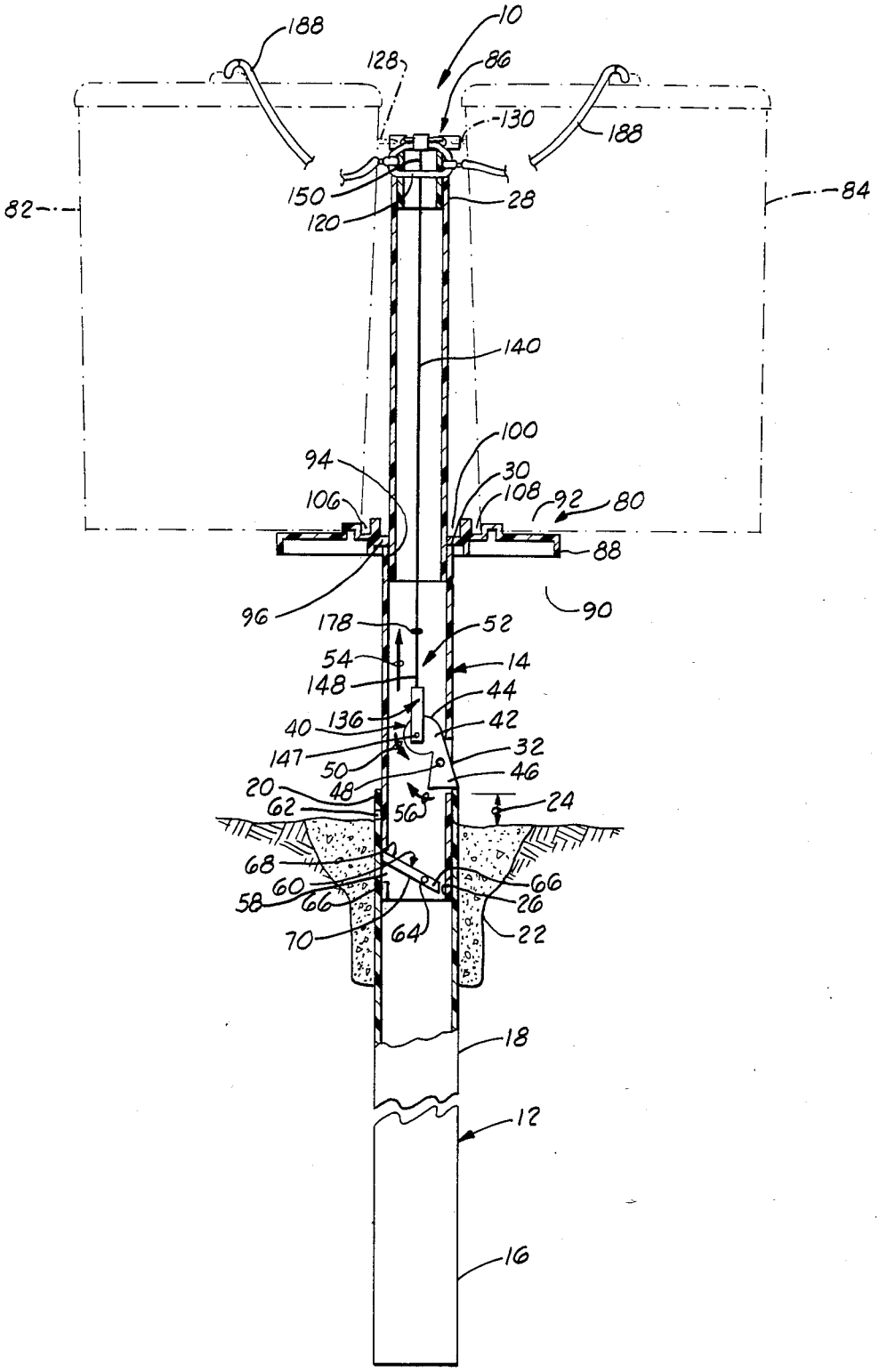
FIG. 2 is an elevational, cutaway view of the improved container support apparatus of FIG. 1 wherein the container support apparatus is in its extended mode for supporting a pair of refuse cans, the refuse cans being illustrated in phantom.

Referring now to the drawings, and more particularly to FIGS. 1 and 2, shown therein is an improved container support apparatus 10 constructed in accordance with the present invention. The improved container support apparatus 10 comprises a stationary tubular member 12 and a telescoping tubular member 14. The telescoping tubular member 14 is supported by the stationary tubular member 12 such that the telescoping tubular member 14 is slidably moveable between a retracted position within the stationary tubular member 12 (as shown in FIG. 1) and an extended position substantially above the surface of the ground (as shown in FIG. 2).

The stationary tubular member 12 has a lower end portion 16, a medial portion 18 and an upper end portion 20. The stationary tubular member 12 is positioned within a hole in the ground and secured in place by any suitable means, such as concrete 22, so that the upper end portion 20 of the stationary tubular member 12 extends a selected distance 24 above the surface of the ground. To insure proper drainage of water which may accumulate in the stationary tubular member 12, the lower end portion 16 of the stationary tubular member 12 can be provided with a plurality of apertures (not shown) or the lower end portion 16 of the stationary tubular member 12 can be left open and substantially unobstructed as shown in FIG. 1.

The telescoping tubular member 14 has a lower portion 26 and an upper portion 28. The upper portion 28 of the support tubular member 14 has outside dimensions which are less than the outside dimensions of that of the lower portion 26 so that a support shoulder 30 is formed at the junction of the lower and upper portions 26, 28. A first detent slot 32 is formed in the lower portion 26 of the telescoping tubular member 14.

Any suitable means can be employed to fabricate the lower and upper portions 26, 28 of the telescoping tubular member 14 so as to provide the support shoulder 30 at the junction of the lower and upper portions 26 and 28. For example, the telescoping tubular member 14 can be formed of two separate tubular members, the tubular lower portion 26 having inside dimensions determined to receive the outside dimensions of the tubular upper portion 28 in a close sliding fit. Thus, upon positioning one end of the tubular upper portion 28 into one end of the tubular lower portion 26, and connecting the two tubular members by any suitable means, such as welding, screws, adhesives and the like, the resulting interconnection of the two tubular members cooperate to form the support shoulder 30.

The tubular members forming the lower portion 26 and the upper portion 28 of the telescoping tubular member 14 can be fabricated of tubular components having a variety of cross-sectional configurations, such as tubular members having circular cross-sectional configurations, rectangular cross-sectional configurations, square cross-sectional configurations, and the like. For orientation purposes, rectangular cross-sectional configurations have served very well. Further, any suitable material can be employed in fabricating the telescoping tubular member 14 and the stationary tubular member 12 of the support apparatus 10 of the present invention, such as plastics, metal or the like.

A first stop assembly 40 is pivotally connected within the lower portion 26 of the telescoping tubular member 14 for selectively locking the telescoping tubular member 14 in the extended position. The first stop assembly 40 comprises a dog detent member 42 having a first end portion 44 and a second end portion 46. The dog detent member 42 is pivotally supported in the lower portion 26 of the telescoping tubular member 14 by any suitable means, such as a pivot pin 48, so that the second end portion 46 of the dog detent member 42 is extendable through the first detent slot 32 formed in the lower portion 26 of the telescoping tubular member 14 when the support tubular member 14 is withdrawn from the stationary tubular member 12 to a position where the first detent slot 32 is disposed above the upper end portion 20 of the stationary tubular member 12. The dog detent member 42 is biased by the weight of its heavier first end portion 44 to rotate in the direction indicated by arrow 50 so that the second end portion 46 of the dog detent member 42 is caused to extend through the first detent slot 32 when the support tubular member 14 is raised to a position such that the first detent slot 32 is above the upper end portion 20 of the stationary tubular member 12. As the support tubular member 14 is lowered, the extending portion of the dog detent member 42 engages the upper end portion 20 of the stationary tubular member 12, holding the telescoping tubular member 14 in its extended position. Thus, the second end portion 46 of the dog detent 42, the first detent slot 32 in the lower portion 26 of the telescoping tubular member 14, and the upper end portion 20 of the stationary tubular member 12 cooperate to secure the telescoping tubular member 14 in the extended position as shown in FIG. 2.

Any suitable means can be employed for biasing the dog detent member 42 within the telescoping tubular member 14 so that the second end portion 46 of the dog detent member 42 will extend through the first detent slot 32 when the telescoping tubular member 14 is in the extended position. As mentioned, the dog detent member 42 can be biased by the weight of its first end portion 44; this is achieved by pivotally connecting the dog detent member 42 within the lower portion 26 of the telescoping tubular member 14 via the pivot pin 48 which is disposed through the dog detent member 42 at a position close to the second end portion 46 and thereafter securing the pivot pin 48 to the opposite side walls of the telescoping tubular member 14. Of course, an appropriately disposed spring could serve as well to bias the rotational characteristics of the dog detent member 42.

Desirably the first detent slot 32 and the dog detent member 42 are positioned and dimensioned such that when the second end portion 46 of the dog detent member 42 is in a retracted position, (i.e. the telescoping tubular member 14 is retracted within the stationary tubular member 12), the second end portion 46 of the dog detent 42 is disposed within and supported by the portion of the telescoping tubular member 14 defining the first detent slot 32. Thus, the second end portion 46 of the dog detent 42 substantially closes off the first detent slot 32 when the telescoping tubular member 14 is in the retracted mode.

Because the dog detent member 42 is biased, and in order to move the telescoping tubular member 14 from the extended mode (as shown in FIG. 2) to the retracted mode (as shown in FIG. 1), a force is applied to the dog detent member 42 sufficient to cause the second end portion 46 of the dog detent member 42 to be rotated inwardly into the telescoping tubular member 14 until it disengages the upper end portion 20 of the stationary tubular member 12. When the second end portion 46 of the dog detent member 42 has disengaged the upper end portion 20 of the stationary tubular member 12, the telescoping tubular member 14 can be moved to its retracted position within the stationary tubular member 12.

In order to apply the desired force to the dog detent member 42 so that the second end portion 46 of the dog detent member 42 disengages the upper end portion 20 of the stationary tubular member 20 and is retracted into the detent slot 32, the support apparatus 10 further comprises a linkage assembly 52 pivotally connected to the first end portion 44 of the dog detent member 42 as illustrated in FIGS. 1, 2 and 6. When an upwardly directed or lifting force is applied to the linkage assembly 52 in the direction represented by arrow 54 the first end portion 44 of the dog detent member 42 is moved in an upwardly direction substantially corresponding to the direction of the arrow 54 and the second end portion 46 of the dog detent member 42 is rotated in the direction of arrow 56. This rotation of the second end portion 46 of the dog detent member 42 results in the second end portion 46 being moved to the retracted position within the detent slot 32 so that the telescoping tubular member 14 can be retracted into the stationary tubular member 12.

In order to prevent unintentional removal of the telescoping tubular member 14 from the stationary tubular member 12 as the telescoping tubular member 14 is moved to the extended mode or position, a second detent slot 58 is formed in the lower portion 26 of the telescoping tubular member 14 a distance below the first detent slot 32. A second stop assembly 60 is disposed within and supported by the lower portion 26 of the telescoping tubular member 14 so that the second stop assembly 60 is aligned with the second detent slot 58 in the telescoping tubular member 14. The second stop assembly 60 is adapted to selectively engage a third detent slot 62 formed in the upper end portion 20 of the stationary tubular member 12 when the telescoping tubular member 14 is extended and the second and third detent slots 58 and 62 are aligned. The engagement of the second stop assembly 60 with the third detent slot 62 in the upper end portion 20 of the stationary tubular member 12 prevents the inadvertent removal of the telescoping tubular member 14 from the stationary tubular member 12.

Figure 7:
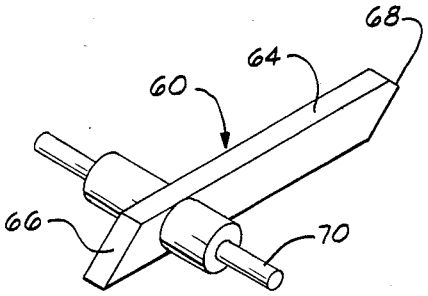
FIG. 7 is an isometric view of a pawl illustrated in FIGS. 1 and 2 for preventing inadvertent removal of a telescoping tubular member from a stationary tubular member of the apparatus of the present invention when the telescoping tubular member is moved in an upwardly direction to position the apparatus in the extended mode.

Referring now to FIGS. 1, 2 and 7, the second stop eassembly 60 comprises a pawl 64 having a first end portion 66 and a second end portion 68. The first end portion 66 of the pawl 64 is pivotally connected to the lower portion 26 of the telescoping tubular member 14 by any suitable means, such as pivot pin 70, such that the second end portion 68 is aligned with and extendable through the second detent slot 58 of the telescoping tubular member 14. Thus, when the second detent slot 58 in the telescoping tubular member 14 is aligned with the third detent slot 62 in the stationary tubular member 12, the second end portion 68 of the pawl 64 engages the stationary tubular member 12 at the third detent slot 62 to prevent the inadvertent removal of the telescoping tubular member 14 from the stationary tubular member 12. The second end portion 68 of the pawl 64 is provided with a suitable configuration (see FIG. 7) such that upon application of a downwardly directed force, the second end portion 68 of the pawl 64 disengages the stationary tubular member 12 and is moved into a retracted position within the second detent slot 58 of the telescoping support member 14. Thus, application of a downwardly directed force on the telescoping tubular member 14 will cause the second end portion 68 of the pawl 64 to retract from the third detent slot 62 in the upper end portion 20 of the stationary tubular member 12 so that the telescoping tubular member 14 can be stabilized in its extended position via dog detent member 42 engaging the upper end portion 20 of the stationary tubular member 12 (as shown in FIG. 2); or, if the dog detent member 42 has been selectively retracted via activation of the linkage assembly 50, the telescoping tubular member 14 can be retracted into the stationary tubular member 12 so as to be in the retracted mode as shown in FIG. 1.

Referring now to FIGS. 1 through 5, the improved telescoping support apparatus 10 further comprises a support assembly 80 slidably disposed about the upper portion 28 of that telescoping tubular member 14 for supporting containers (such as refuse containers 82 and 84 shown in phantom in FIG. 1), and a handle assembly 86 secured to the upper portion 28 of the telescoping tubular member 14 for selectively moving the telescoping tubular member 14 between the extended position and the retracted position. The support assembly 80 comprises a body member 88 having a lower side 90 and an upper side 92. The body member can be fabricated as a solid member, or, in an effort to conserve materials, as a member having a hollow lower side substantially as shown in the drawings. However, when fabricating the body member 88 so as to have a hollow lower side a plurality of ribs and other reinforcing elements (not shown) are generally formed on the lower side 90 of the body member 88 to provide the body member 88 with the desired strength. When the body member 88 is fabricated of moldable materials, such as plastic, the ribs and other structural elements formed on the lower side can be readily designed during the fabrication of the mold.

The body member 88 of the support assembly 80 is further provided with a substantially centrally disposed bore 94 which extends through the body member 88 from the lower side 90 to the upper side 92. The bore 94 has a configuration substantially corresponding to the configuration of the telescoping tubular member 14.

However, the bore 94 is provided with a diameter somewhat greater than the outside diameter of the upper portion 28 of the telescoping tubular member 14, but less than the outside diameter of the lower portion 26 of the telescoping tubular member 14. Thus, in an extended position of the telescoping tubular member 14 the body member 88 of the support assembly 80 is supported by the support shoulder 30 formed at the junction of the lower and upper portions 26, 28 of the telescoping tubular member 14. In addition, the dimensions of the bore 94 with respect to the upper portion 28 of the telescoping tubular member 14 permits the body member 88 of the support assembly 80 to wobble and be angularly disposed with respect to the upper portion 28 of the telescoping tubular member 14, and thus the stationary tubular member 12, to compensate for slight variations in the surrounding ground in which the stationary tubular member 12 is implanted. This wobbling variation enables one to maintain the refuse containers, such as the refuse containers 82 and 84 shown in phantom in FIG. 2, in a substantially upright position regardless of slight variations in the ground surface or terrain in which the telescoping support apparatus 10 of the present invention is employed. Further, this wobbling variation further enables one to position the body member 88 of the support assembly 80 substantially adjacent the ground when the telescoping support apparatus 10 is in its retracted position, i.e. when the telescoping tubular member 14 is retracted within the stationary tubular member 12 substantially as shown in FIG. 1.

Figure 4:
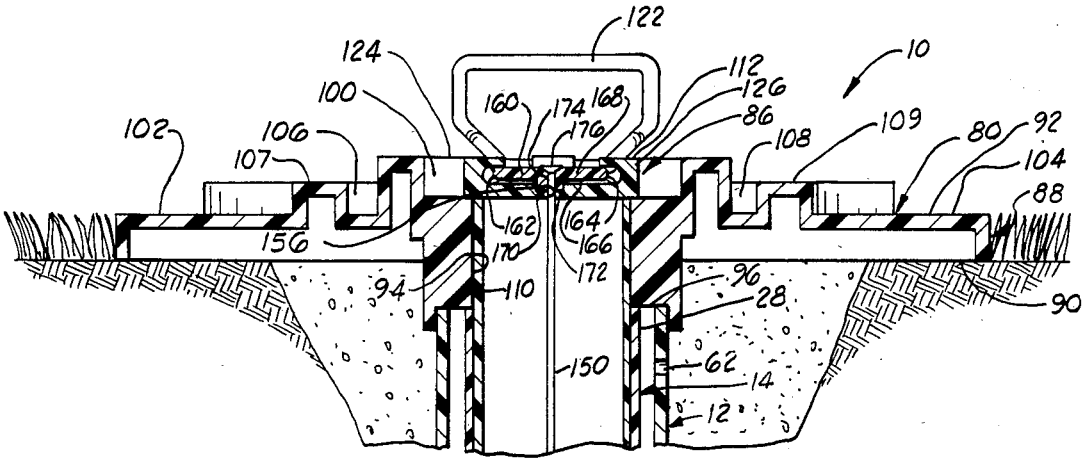
FIG. 4 is a fragmentary, cross sectional view of the improved container support apparatus taken along the line 4—4 in FIG. 3 and illustrating the handle of the apparatus in a raised position.
Figure 5:
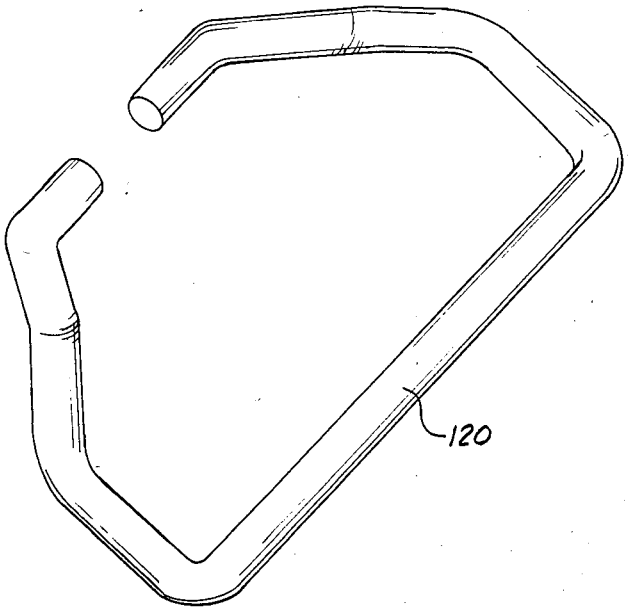
FIG. 5 is a partially broken, cross sectional view of the improved container support apparatus taken along the line 5—5 in FIG. 3.

The body member 88 of the support assembly 80 is further characterized as having a flange 96 formed around the portion of the body member 88 defining the bore 94 (see FIGS. 4 and 5). The flange 96 formed in the body member 88 engages the support shoulder 30 of the telescoping tubular member 14 when the telescoping tubular member 14 is in the extended position (as shown in FIG. 2); and the flange 96 engages the upper end portion 20 of the stationary tubular member 12 when the telescoping tubular member 14 is in the retracted position within the stationary tubular member 12 (as shown in FIGS. 1, 4 and 5).

The upper side 92 of the body member 88 is provided with a centrally disposed recessed portion 100, a first recessed side portion 102, and an oppositely disposed second recessed side portion 104 formed therein (see FIGS. 3 and 4) such that the recessed portions 100, 102, and 104 have a surface substantially normally disposed to the elongated axis of the stationary tubular member 12 and the telescoping tubular member 14. The first and second recessed side portions 102 and 104 formed in the upper side 92 of the body member 88 are each provided with an arcuate shaped groove segment, such as groove segments 106 and 108 which are bounded by the arcuate ridges 107 and 109, respectively, that extend upwardly from the upper side 92. The upper surface 92 is recessed beyond the ridges 107 and 109 so as to prevent interference with the bottoms of the garbage cans 82 and 84 (the bottom partition of a conventional garbage can often bow downwardly toward the center of the can).

The first and second recessed side portions 102 and 104 of the body member 88 are adapted to receive and support substantially rectangularly shaped refuse containers; whereas the arcuate shaped groove segments 106 and 108 are designed to receive the lower rim of substantially circularly shaped containers so that the containers are stabilized on the body member 88 of the support assembly 80.

Figure 3:
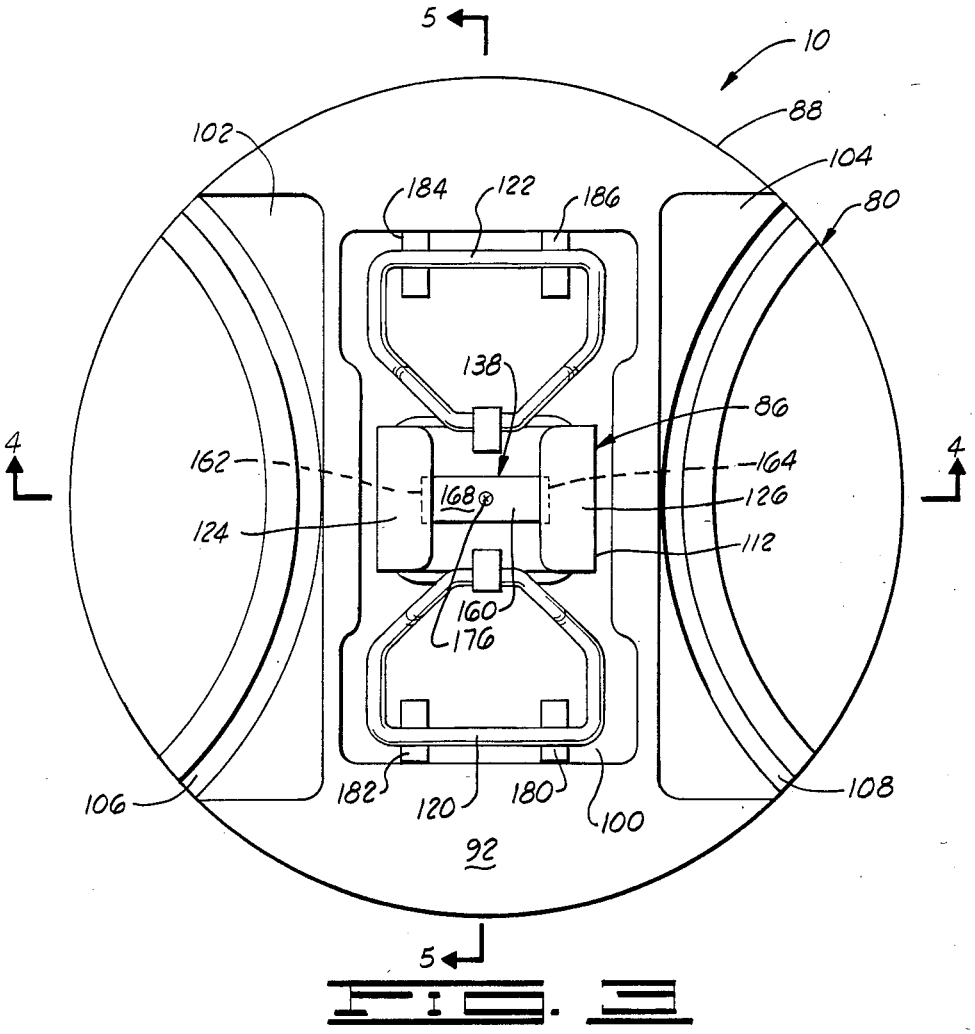
FIG. 3 is a top plan view of the improved container support apparatus of FIG. 1 when the container support apparatus is in its retracted mode as illustrated in FIG. 1.
Figure 3:
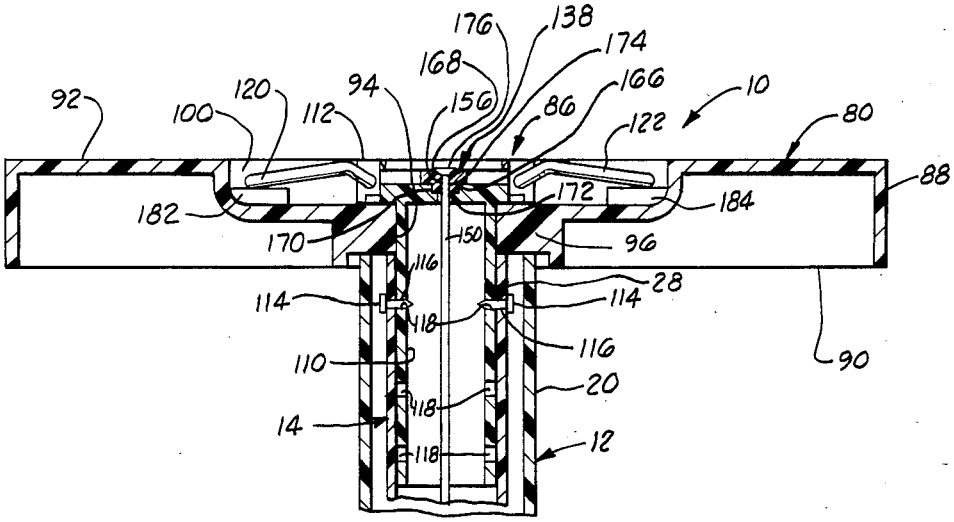
Figure 8:
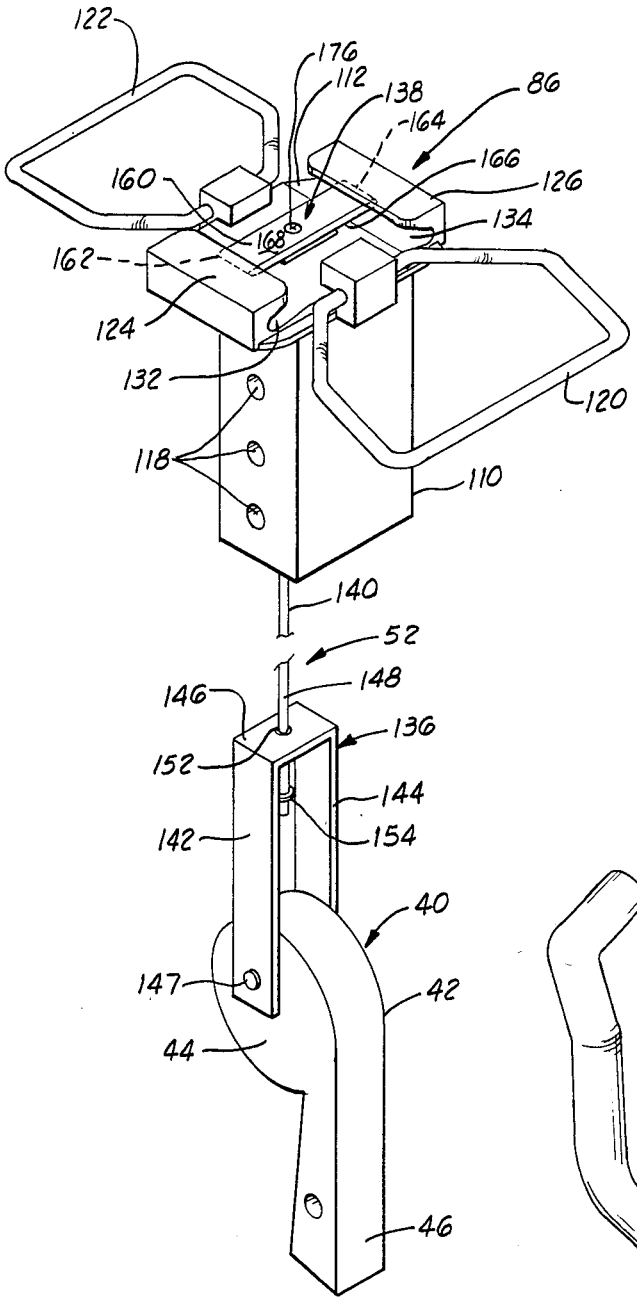
FIG. 8 is an enlarged isometric view of a handle of the handle assembly of the improved container support apparatus of FIG. 1.

The centrally disposed recessed portion 100 formed in the upper side 92 of the body member 88 is positioned between the first and second recessed side portions 102 and 104 substantially as shown in FIGS. 3 and 5. The centrally disposed recessed portion 100 permits the handle assembly 86 to be positioned within the centrally disposed recessed portion 100 when the handle assembly 86 is in a retracted position so that the handle assembly 86 does not extend above the upper side 92 of the body member 88.

The hand assembly 86, illustrated as a substantially T-shaped assembly, comprises a body member having a throat portion 110 and a substantially normally disposed upper portion 112. The throat portion 110 of the handle assembly 86 is positionable within the upper portion 28 of the telescoping tubular member 14 and secured thereto by any suitable means, such as screws 114 inserted through axially aligned holes 116 and 118 in the walls of the upper portion 28 of the telescoping tubular member 14 and the throat portion 110 of the handle assembly 86, respectively. The plurality of holes 118 disposed through opposing side walls of the throat portion 110 are spaced apart at predetermined intervals, such as one inch each. By aligning the holes 116 of the upper portion 28 of the telescoping tubular member 14 with a selected pair of holes 118 in the throat portion 110 of the handle assembly 86, and thereafter positioning screws 114 therethrough, the throat portion 110 of the handle assembly 86 is firmly secured to the upper portion 28 of the telescoping tubular member 14. The selection of the particular set of holes 118 in the throat portion 110 of the handle assembly 86 determines the height of the handle assembly 86 above the upper side 92 of the body member 88 of the support assembly 80 when the container support apparatus 10 is in its extended position as shown in FIG. 2. That is, the throat portion 110 of the handle assembly 86 is connectable to the upper portion 28 of the telescoping tubular member 14 and extends therefrom a preselected distance. This feature permits adjustment of the telescoping support apparatus 10 to accomodate different sizes of refuse containers, as will be clear in the description following.

The upper portion 112 of the handle assembly 86 is positionable within the centrally disposed recessed portion 100 of the body member 88 of the support assembly 80 when the telescoping tubular member 14 is in its retracted position within the stationary tubular member 12. The handle assembly 86 further comprises a pair of oppositely disposed handle member 120 and 122 which are pivotally connected to the upper portion 112 of the handle assembly 86 so that the handle members 120 and 122 can be selectively disposed in the centrally disposed recessed portion 100 formed in the upper side 92 of the body member 88 when the telescoping tubular member 14 is in its retracted position within the stationary tubular member 12 (as illustrated in FIGS. 4 and 5); or the handle members 120 and 122 can be selectively pivoted upwardly for grasping by a person to move the telescoping tubular member 14 to its extended position with respect to the stationary tubular member 12 substantially as shown in FIG. 2.

The handle members 120, 122, illustrated as substantially hexagonal shaped members, are provided with side portions which are angularly disposed in a downwardly extending direction as illustrated in FIG. 5. The angles formed in the side portions of the handle members 120, 122 cause the center of gravity of each of the handle members 120, 122 to be located near the hand gripping end portion of the handle members 120, 122. Thus, when the handle members 120, 122 are in the raised position so as to abut the adjacent end portions of a pair of container handle engaging rib members 124 and 126 (as illustrated in FIG. 2) and thereafter released, the handle members 120, 122 will fall to a rest position within the centrally disposed recessed portion 100 in the upper side 92 of the body member 88. Thus, the handle members 120, 122 are normally maintained in the rest position within the centrally disposed recessed portion 100 of the upper side 92 of the body member 88 except when the handle members 120, 122 are grasped by the user and moved to the raised position for either extending or retracting the telescoping member 14 within the stationary tubular member 12. This feature prevents damage to the handle members 120, 122, as well as provides a safety feature by preventing injury to persons caused by persons tripping over the members when the support apparatus is in the retracted mode.

To secure the upper portion of the refuse containers (such as the refuse containers 82 and 84 shown in phantom in FIG. 2) to the handle assembly 86, and to further stabilize the refuse containers 82 and 84 with respect to the container support apparatus 10 when same is in its extended mode, the container handle engaging rib members 124 and 126 (see FIGS. 3, 4 and 6) are formed on the upper portion 112 of the handle assembly 86 so as to be disposed substantially adjacent the refuse containers when same are positioned and supported on the upper side 92 of the body member 88 of the support assembly 80. The handle engaging rib members 124 and 126 are each constructed so that an adjacently disposed handle of a refuse container, such as handles 128 and 130 of the refuse containers 82 and 84 (shown in phantom in FIG. 2), can be positioned over one of the handle engaging rib members 124 and 126 to secure the refuse containers to the handle assembly 86 when the telescoping tubular member 14 is in the extended mode.

As more clearly shown in FIG. 6, the handle engaging rib members 124 and 126 of the handle assembly 86 are each provided with a groove or recessed portion 132, 134, respectfully, which are formed along an inwardly disposed side of each of the handle engaging rib members 124 and 126 so that the recessed portions or grooves 132 and 134 are in a facing relationship. The recessed portions or grooves 132 and 134 formed in the handle engaging rib members 124 and 126 are adapted to receive a handle of a refuse container, such as handles 128 and 130 of the refuse containers 82 and 84 (shown in phantom in FIG. 2), so that when the container support apparatus 10 has been moved to its extended position, and the refuse containers have been positioned on the upper side 92 of the body member 88 of the support assembly 80, the handles 128 and 130 can be disposed over the handle rib engaging members 124 and 126 and positioned within the recessed portions or grooves 132, 134 of the handle engaging rib members 124 and 126 so as to secure the refuse containers to the container support apparatus 10.

Referring now to FIGS. 1, 2 and 6, the linkage assembly 52 employed to retract the second end portion 46 of the dog detent member 42 from engagement with the upper end portion 20 of the stationary tubular member 12 so that the telescoping tubular member 14 can be moved to its retracted mode is illustrated. The linkage assembly 52 comprises a yoke member 136, a finger graspable handle 138, and an elongated linkage member 140 interconnecting the yoke member 136 to the finger graspable handle 138.

As more clearly illustrated in FIG. 6, the yoke member 136 is a substantially U-shaped member having parallel, spatially disposed leg members 142, 144 interconnected at an upwardly extending portion by a cap or closure member 146. The leg members 142 and 144 are each provided with an aperture (not shown) in a lower portion thereof. These apertures are alignable with an aperture (also not shown) in the first end portion 44 of the dog detent member 42 so that when the first end portion 44 of the dog detent member 42 is positioned between the leg members 142 and 144 of the yoke member 136, the yoke member 136 can be pivotally connected to the dog detent member 42 via a hollow arbor member (not shown) which extends through the aperture provided in the dog detent member 42, and the leg members 142 and 144 are secured to said arbor via rivets 147, only one of which is shown in FIG. 6.

The elongated linkage member 140 is characterized as having a first or lower end portion 148 and a second or upper end portion 150 (see FIGS. 4 and 5). The lower or first end portion 148 of the linkage member 140 is connected to the yoke member 136 by any suitable means, such as by providing an aperture 152 in the closure or cap member 146 of the yoke member 136, and by positioning the lower end portion 148 of the linkage member 140 through the aperture 152 so that a portion of the lower or first end portion 148 is disposed below the closure or cap member 146. To prevent the lower or first end portion 148 of the linkage member 140 from being pulled through the aperture 152 formed in the closure or cap member 146 upon activation of the linkage assembly 52, the lower or first end portion 148 of the linkage member 140 is enlarged by any suitable means, such as by providing a stop member 154 on the lower end portion 148. The linkage member 140 is disposed within the telescoping tubular member 114 and extends upwardly through an internally formed passageway of the throat portion 110 of the handle assembly 86 and through an aperture 156 (see FIGS. 4 and 5) formed in the centrally disposed recessed portion 100 of the upper portion 112 of the handle assembly 86 (which openly communicates with the passageway through the throat portion) so that the second end portion 150 of the elongated linkage member 140 can be connected to the finger graspable handle 138. The interconnection of the elongated linkage member 140 to the yoke member 136 and to the finger graspable handle 138 permits the finger graspable handle 138 to be selectively rotated to position the finger graspable handle 138 in a locked secured position within the recessed portions or grooves 132 and 134 of the handle engaging rib members 124, 126 of the handle assembly 86 (as shown in FIG. 6); or the finger graspable handle 138 can be moved to an unlocked position and lifted in an upwardly direction indicated by the arrow 54 thereby disengaging the second end portion 46 of the dog detent member 42 from the upper end portion 20 of the stationary tubular member 12 so that the telescoping tubular member 14 can be moved to its retracted position within the stationary tubular member 12.

The finger graspable handle 138 is characterized as an elongated body member 160 having a first end 162 and opposed second end 164, a lower side 166 and an upper side 168. A substantially centrally disposed shoulder or collar portion 170 (see FIGS. 4 and 5) is formed on the lower side 166 of the body 160 of the finger graspable handle 138. The shoulder or collar portion 170 is positionable within a recessed portion 172 formed in the centrally disposed recessed portion 100 of the body member 88 of the handle assembly 86 surrounding the aperture 156 extending through the body member 88. The body member 160 of the finger graspable handle 138 is further provided with an aperture 174 which extends through the shoulder or collar portion 170 and the body member 160. The aperture 174 is adapted to receive the upper or second end portion 150 of the elongated linkage member 140 of the linkage assembly 52 so that the elongated linkage member 140 can be secured to the finger graspable handle 138 by any suitable means, such as a screw 176.

The body member 160 of the finger graspable handle 138, which is rotatable within the centrally disposed recessed portion 100 of the body member 88 of the handle assembly 86 is dimensioned such that when the elongated axis of the body 160 is disposed substantially normal to the axis of the recessed portions or grooves 132, 134, the first end 162 of the body member 160 is secured within a portion of the groove 132 formed in the handle engaging rib member 124, and the opposed second end 164 of the body 160 is secured within a portion of the recessed portion or groove 134 formed in the handle engaging rib member 126. Thus, upon locking the body 160 of the finger graspable handle 138 within the recessed portions or grooves 132 or 134 as described above, the finger graspable handle 138 assists in securing the handle members of refuse containers to the handle assembly 86 when such containers are supported by the support assembly 80 as illustrated in FIG. 2.

The linkage assembly 52 described above readily allows the user of the improved container support apparatus 10 to remove the second end portion 46 of the dog detent member 42 from contact with the upper end portion 20 of the stationary tubular member 12 when it is desired to retract the telescoping tubular member 14 within the stationary tubular member 12. In instances where the lower or first end portion 148 of the elongated linkage member 140 is disposed through the aperture 152 in the closure or cap member 146 of the yoke member 136 and the upward movement is restricted by the use of the stop member 154, it is desirable to provide a second stop member 178 a selected distance from the lower or first end portion 148 of the elongated linkage member 140 (as illustrated in FIGS. 1 and 2). Thus, the stop member 154 engages the yoke member 136 of the linkage assembly 52 when the finger graspable handle 138 is moved to the unlocked position and a lifting force is applied thereto; whereas when the finger graspable handle 138 is secured in the locked position (as heretofore described) the second stop member 178 restricts the downward movement of the lower or first end portion 148 of the elongated linkage member 140 so that the lower or first end portion 148 does not interfere with the rotational movement of the dog detent member 42.

The handle members 120, 122 of the handle assembly 86 can be provided with any suitable configuration as heretofore described. However, since the support assembly 80 is disposed substantially at ground level when the telescoping tubular member 14 is in its retracted position within the stationary tubular member 12, it is desirable that no elements protrude to present a tripping hazzard or to hinder the movement of a lawnmower over the upper portion of the apparatus. When the handle members 120, 122 of the handle assembly 86 are in an upwardly extensive position, the handle members 120, 122 contact the adjacent end portions of the handle engaging rib members 124 and 126 such that the centers of gravity of the handles are located at a position away from the outermost edges of the body member 88 of the handle assembly 86. By forming the handles so that the center of gravity of each of the handle members 120 and 122 is located away from the outermost edges of the body member 88, the handle members 120 and 122 will automatically fall to a rest position within the centrally disposed recessed portion 100 formed in the upper side 92 of the body member 88. Thus, the handle members 120, 122 will not be inadvertently maintained in a raised position when the improved container support apparatus 10 is in either its extended mode or in its retracted mode.

In order to assist a person in the grasping of the handle members 120, 122 for the raising or lowering of the improved container support apparatus 10, a plurality of rib members 180, 182, 184 and 186 are formed along the upper side 92 of the body member 88 of the handle assembly 86. The rib members 180, 182, 184 and 186 extend inwardly so as to receive and support the hand grasping portion of each of the handle members 120, 122. Thus, the handle members 120 and 122 can more readily be pivoted upward for grasping by a person's hand so as to move the telescoping tubular member 14 to its extended position with respect to the stationary tubular member 12 (substantially as shown in FIG. 2), or to move the telescoping tubular member 14 to its retracted position with respect to the stationary tubular member 12 (substantially as shown in FIG. 1).

In the operation of the improved container support apparatus 10 of the present invention, and assuming that the apparatus 10 is in its retracted position as shown in FIG. 1, an operator need merely grasp the handle members 120, 122 of the handle assembly 86 and raise the telescoping tubular member 14 upwardly until the first detent slot 32 in the telescoping tubular member 14 clears the upper end portion 28 of the stationary tubular member 12. When the first detent slot 32 is clear of the upper end portion 20 of the stationary tubular member 12, the dog detent member 42 of the first stop assembly 40 pivots in the direction of the arrow 50 so that the second end portion 46 of the dog detent member 42 extends outwardly through the first detent slot 32. Thereafter, by lowering the stationary tubular member 12, the second end portion 46 of the dog detent member 42 engages the upper end portion 20 of the stationary tubular member 12 and secures the telescoping tubular member 14 in its extended position. Meanwhile, the support assembly 80 slides down the upper portion 28 of the telescoping tubular member 14 and comes to rest on the support shoulder 30 formed at the junction of the lower portion 26 and the upper portion 28 of the telescoping tubular member 14. In this position, the refuse containers (such as refuse containers 82 and 84 shown in phantom in FIG. 2) are set upon the support assembly 80 so that the rims of the bottom portions of the containers engage the arcuate shaped grooved segments 106 and 108 formed in the upper side 92 of the body member 88. The handles 128 and 130 of the refuse containers 82 and 84 can then be disposed over the respective handle engaging rib members 124 and 126 and positioned within the recessed portions 132, 134 thereof to stabilize the refuse containers on the suppport assembly 80. Thereafter, the body 160 of the finger graspable handle 138 is then selectively rotated such that the first end 162 is disposed within a portion of the recessed portion or groove 132 of the handle engaging member 124, and the opposed second end 164 of the body 160 is disposed within a portion of the recessed portion or groove 134 of the handle engaging rib member 126. Thus, the body member 160 of the finger graspable handle 138 of the linkage assembly 52 secures and stabilizes the handles 128 and 130 of the refuse container within the recessed portions 132 and 134 of the handle engaging rib members 126, 124 of the handle assembly 86. In addition, other means can be employed for securing the lid portions of the refuse containers to the improved container support apparatus 10 if required, such as a pair of ropes 188 (illustrated in FIG. 2). As illustrated in FIG. 2, one end of each rope 188 is looped to the handle of one of the garbage cans 82, 84, and the other end of each rope 188 is secured to the handle member 120 ( or alternately to the handle member 122) via a conventional spring latch or the like which is connected to said other end of each rope 188.

To return the improved container support apparatus 10 to its retracted position, the refuse containers 82 and 84 are removed and the finger graspable handle 138 is turned to an unlocked position. The telescoping tubular member 14 is then raised via the handle members 120 and 122 so that the second end portion 46 of the dog detent member 42 protruding through first detent slot 32 formed in the telescoping tubular member 14 is disposed above the upper end portion 20 of the stationary tubular member 12. The operator then pulls upwardly on the finger graspable handle 138. As the finger graspable handle 138 is moved upwardly the dog detent member 42 is pivoted upon pivot pin 48 so that the second end portion 46 of the dog detent member 42 is rotated inwardly in the direction of the arrows 56 until the second end portion 46 clears the upper end portion 20 of the stationary tubular member 12. While maintaining the upward force on the finger graspable handle 138 the telescoping tubular member 14 is lowered into the stationarly tubular member 12. The support assembly 80 will slide on the upper portion 28 of the telescoping tubular member 14 until it resumes the position illustrated in FIG. 1 when the telescoping tubular member 14 is fully retracted within the stationary tubular member 12.

The unintentional removal of the telescoping tubular member 14 from the stationary tubular member 12 (as the telescoping tubular member 14 is moved to either the extended position or returned to the retracted position as described above) is prevented by the second stop assembly 60. When the telescoping tubular member 14 is moved upwardly, the second end portion 68 of the pawl 64, (which is retained in the second detent slot 58 formed in the lower portion 26 of the telescoping tubular member 14), engages the upper portion of the stationary tubular member 12 via the third detent slot 62 and prevents continued upward movement of the telescoping tubular member 14. Because of the unique design of the second end portion 68 of the pawl 64, and the pivotal connection of the pawl 64 to the telescoping tubular member 14 via the pivot pin 70, application of a downward force on the telescoping tubular member 14 will automatically disengage the second end portion 68 of the pawl 64 from the stationary tubular member 12 so that the telescoping tubular member 14 can be lowered into the stationary tubular member 12.

As previously stated, the support assembly 80 is designed such that it can assume various pivotal positions relative to the upper portion 28 of the telescoping tubular member 14, and thus the stationary tubular member 12. Thus, the support assembly 80 remains in a substantially level position when uneven or sloped terrain is encountered. Further, this pivoting feature enables the refuse containers (such as the refuse containers 82 and 84 illustrated in phantom in FIG. 2) to be maintained in a substantially upright stable position when the improved container support apparatus 10 is positioned in sloped terrain.

When the refuse containers supported by the improved container support apparatus 10 are refuse bags, the operator will first move the support apparatus 10 to the extended position. The refuse bags are then positioned on the body member 88 of the support assembly 80. Thereafter, the operator can secure the bags to the handle assembly 86 by any suitable means, such as by placing a portion of the bag into the recessed portions or grooves 132 and 134 formed in the handle engaging rib members 124 and 126. The finger graspable handle 138 is then moved to its locked position to secure the upper end portion of the bags to the handle assembly 86.

It is clear that the present invention is well adapted to carry out the objects and attain the ends and advantages mentioned as well as those inherent therein. While presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. An improved container support device for supporting at least one refuse container, comprising:

a stationary tubular member disposable in the ground and having an upper end portion extendible a selected distance above the surface of the ground;

a telescoping tubular member supported by the stationary tubular member and slidably movable between a retracted position within the stationary tubular member and an extended position substantially above the surface of the ground, the telescoping tubular member having an upper portion and a lower portion, the lower portion having a first detent slot formed therein;

first stop means supported within the lower portion of the telescoping tubular member for selectively locking the telescoping tubular member in the extended position, the first stop means pivotally supported in the lower portion of the telescoping tubular member so that an end portion of the first stop means is selectively extendible through the first detent slot in the lower portion of the telescoping tubular member for engagement with the stationary tubular member so as to prevent movement of the telescoping tubular member to a retracted position when the first stop means is extended through the first detent slot;

support means slidably disposed about the the telescoping tubular member for supporting the container thereon when the telescoping tubular member is in the extended position, the support means adapted to engage the upper end portion of the stationary tubular member when the telescoping tubular member is in the retracted position;

handle means secured to the upper portion of the telescoping tubular member for selectively moving the telescoping tubular member between one of the extended position and the retracted position; and linkage means operably connected to the first stop means for selectively removing the first stop means from engagement with the stationary tubular member and for permitting the telescoping tubular member to be retracted into the stationary tubular member.

2. The improved container support device of claim 1 further comprising:

shoulder means formed on the telescoping tubular member for engaging and supporting the support means when the telescoping tubular member is disposed in the extended position.

3. The improved container support device of claim 2 wherein the upper portion of the telescoping tubular member has an outside diameter less than the outside diameter of the lower portion of the telescoping tubular member and the junction of the upper and lower portions forms the support means.

4. The improved container support device of claim 2 wherein the first stop means comprises:

a dog detent member pivotally supported on the lower portion of the telescoping tubular member so that an end portion of the dog detent member is aligned with, supported within, and extendible through the first detent slot, the dog detent member being biased to rotate outwardly through the first detent slot and into supporting engagement with the upper end portion of the stationary tubular member when the telescoping tubular member is in the extended position, the dog detent member being inwardly movable for disengagement with the upper end portion of the stationary tubular member when the telescoping tubular member is moved to the retracted position.

5. The improved container support device of claim 2 further comprising:

second stop means supported within the lower portion of the telescoping tubular member a distance below the first stop means for selectively engaging an upper portion of the stationary tubular member and preventing inadvertent removal of the telescoping tubular member from the stationary tubular member during movement of the telescoping tubular member between one of the extended position and the retracted position.

6. The improved container support device of claim 5 wherein the telescoping tubular member is provided with a second detent slot formed a distance below the first detent slot, the second detent slot being aligned with the second stop means, and the stationary tubular member is provided with a third detent slot formed in the upper end portion thereof, the third detent slot being alignable with the second detent slot in the telescoping tubular member when the telescoping tubular member is extended from the stationary tubular member, and wherein the second stop means comprises:

a pawl having a first end portion and a second end portion, the first end portion being pivotally connected to the lower portion of the telescoping tubular member such that the second end portion is aligned with, supported by, and extendable through the second detent slot and into engagement with the stationary tubular member via the third detent slot when the telescoping tubular member is moved past the extended position within the stationary tubular member.

7. The improved container support device of claim 2 wherein the support means comprises:

a body member having a substantially centrally disposed bore extending therethrough, the body member characterized as having a lower side and an upper side, the bore having a diameter less than the outside diameter of the stationary tubular member, the body member defining a flange portion around the periphery of the bore such that the flange portion engages the upper end portion of the stationary tubular member when the telescoping tubular member is in the retracted position and the flange portion engages the shoulder means of the telescoping tubular member when the telescoping tubular member is in the extended position.

8. The improved container support device of claim 7 wherein the upper side of the body member is provided with at least one recessed side portion, the recessed side portion having an arcuate shaped groove segment formed therein, the recessed portion and groove segment adapted to receive a lower portion of a container so as to stabilize the container on the body member.

9. The improved container support device of claim 7 wherein the upper side of the body member is provided with oppositely disposed side recessed portions extending outwardly from the bore formed in the body member, the side recessed portions each defining a surface substantially normal to the elongated axis of the stationary tubular member and the telescoping tubular member, the side recessed portions each having an arcuate shaped groove segment formed in the surface thereof, the arcuated shaped groove segments adapted to receive a lower rim of a container positioned thereon so as to stabilize the container on the body member.

10. The improved container support device of claim 9 wherein the side recessed portions are substantially U-shaped recessed portions.

11. The improved container support device of claim 9 wherein the body member is provided with a centrally disposed recessed portion extending outwardly from the bore formed in the body member, the centrally disposed recessed portion adapted to receive the handle means when the telescoping tubular member is in the retracted position.

12. The improved container support device of claim 2 wherein the handle means comprises:

a substantially T-shaped member having a throat portion and a substantially normally disposed upper portion, the throat portion connectable to the upper portion of the telescoping tubular member such that in the retracted position of the telescoping tubular member the normally disposed upper portion of the T-shaped member is supported by the flange in the body member; and at least one handle member pivotally connected to the upper portion of the T-shaped member.

13. The improved container support device of claim 12 wherein the handle member is provided with a gripping portion defining a handle opening therein, and wherein the handle means further comprises at least one container handle engaging rib member having an elongated groove formed in the inwardly disposed side, the handle engaging rib member being disposed substantially normal to the handle member of the handle means such that upon positioning a refuse container upon an adjacently disposed side portion of the body member of the support means a handle of the refuse container can be positioned over the rib engaging member and into the elongated groove for securing the refuse container thereto.

14. The improved container support device of claim 13 wherein the handle member of the handle means is characterized as having a handle gripping portion and two oppositely disposed side portions, each of the side portions having a downwardly extending bend formed therein such that when the handle is moved to a raised position and released the center of gravity of the handle member causes the handle member to fall to rest within the centrally disposed recessed portion of the body member of the support means.

15. The improved container support device of claim 13 wherein the throat portion of the substantially T-shaped member is provided with a plurality of apertures in opposite sides, each of the apertures being axially aligned with an oppositely disposed aperture, and the upper portion of the telescoping tubular member is provided with at least one axially aligned aperture in opposite sides which are selectively alignable with a pair of axially aligned apertures in the throat portion, and wherein the handle means further comprises connecting means for connecting the throat portion of the T-shaped member to the upper portion of the telescoping tubular member via alignment of selected apertures in the throat portion with the apertures in the upper portion of the telescoping tubular member.

16. The improved container support device of claim 15 wherein the upper portion of the T-shaped member of the handle means is provided with a centrally disposed aperture openly communicating with a centrally disposed vertically disposed passageway extending through the throat portion of the T-shaped member, and wherein the linkage means comprises:

a substantially U-shaped yoke member pivotally connected to the first end portion of the dog detent member;

an elongated linkage member having a first end portion and a second end portion, the first end portion operably connected to U-shaped yoke member and the second end extending upwardly through the vertically disposed passageway of the throat portion and centrally disposed aperture in the upper portion of the T-shaped member; and a finger graspable handle connected to the second end portion of the elongated linkage member such that upon application of an upwardly directed force on the finger graspable handle a lifting motion is imparted to the yoke member via the elongated linkage member such that the second end portion of the dog detent member is retracted into the first detent slot and into a non-engaging position with the upper end portion of the stationary tubular member.

17. The improved container device of claim 16 wherein the first end portion of the dog detent member is provided with an aperture extending therethrough, and wherein the substantially U-shaped yoke member is provided with a pair of spatially disposed leg member and a cap member interconnecting said leg members, each of said leg members having an aperture extending therethrough such that upon positioning in first end portion of the dog detent member therebetween the apertures in the leg members and the aperture in the first end portion of the dog detent member are axially aligned, and wherein the linkage means further comprises a pivot pin positionable through the aligned apertures in the leg members and the first end position of the dog detent member for pivotally connecting the first end portion of the dog detent member to the leg members of the yoke member.

18. The improved container device of claim 17 wherein the first end portion of the elongated linkage member is disposed through the aperture in the cap member of the substantially U-shaped yoke member, and wherein the linkage means further comprises stop means connected to the first end portion of the elongated linkage member for preventing disengagement of the first end portion of te elongated member with the U-shaped yoke member while permitting restricted sliding movement of the first end portion of the elongated linkage movement through the aperture in the cap member of the substantially U-shaped yoke member without interferring with the desired movement of the dog detent member.

19. The improved container device of claim 18 wherein the finger graspable handle is an elongated member having a first end, an opposed second end, an upper side, a lower side, and a centrally disposed aperture extending therethrough for receiving and connecting the second end portion of the linkage member to the elongated member, the first and second ends of the elongated member adapted to engage a portion of the handle engaging rib members defining the grooves therein to secure and lock the handles of the refuse containers in the grooves when the elongated member is disposed substantially normal to the elongated axis of the grooves.

20. The improved container device of claim 19 wherein the normally disposed upper portion of the T-shaped member of the handle means is provided with a recessed portion disposed about the aperture extending therethrough, and wherein the finger graspable handle further comprises a centrally disposed shoulder portion formed on the lower side of the elongated member, the shoulder having a bore extending therethrough which is aligned with the aperture in the elongated member, the shoulder portion positionable within the recessed portion of the normally disposed upper portion of the T-shaped member of the handle means when the first and second ends of the elongated member of the finger graspable handle are in a locked position engaging a portion of the handle engaging rib members, and connecting means for securing the elongated member of the finger graspable handle to the second end of the linkage member.

* * * * *